United States Patent [19]

Risi et al.

[11] Patent Number: 4,490,075

[45] Date of Patent: Dec. 25, 1984

[54] RETAINING WALL SYSTEM

[76] Inventors: Angelo Risi; Antonio Risi, both of P.O. Box 370, Gormley, Ontario, Canada, L0H 1G0

[21] Appl. No.: 408,619

[22] Filed: Aug. 16, 1982

[51] Int. Cl.[3] ..... E02D 29/02; E04C 1/04

[52] U.S. Cl. ..... 405/273; 405/286; 52/567

[58] Field of Search ..... 405/33, 262, 272, 273, 405/284, 286; 52/566, 567, 593, 594

[56] References Cited

U.S. PATENT DOCUMENTS

| | | | |
|---|---|---|---|
| 1,733,790 | 10/1929 | Gilman | 405/273 |
| 1,907,053 | 5/1933 | Flath | 405/273 |
| 2,094,167 | 9/1937 | Evers | 405/273 |
| 2,197,960 | 4/1940 | Alexander | 405/273 |
| 2,371,201 | 3/1945 | Wells | 52/567 |
| 4,314,431 | 2/1982 | Rabassa | 52/593 X |

FOREIGN PATENT DOCUMENTS

| | | | |
|---|---|---|---|
| 1811932 | 6/1978 | Fed. Rep. of Germany | 405/286 |
| 2755833 | 7/1978 | Fed. Rep. of Germany | 405/15 |

*Primary Examiner*—Andrew V. Kundrat
*Assistant Examiner*—Nancy J. Stodola
*Attorney, Agent, or Firm*—Weldon F. Green

[57] ABSTRACT

An interlocking block and a retaining wall system derived from such blocks wherein the blocks when arranged to extend in horizontal courses in end to end relation and one upon the other in interlocking overlapping wall defining relation automatically uniformly incline to the vertical, such interlocking block having an axis terminating in spaced apart end walls and bounded by generally flat top and bottom walls arranged in parallel relation to each other and by front and rear facings extending from end wall to end wall and so spaced apart as to provide a substantially uniform cross-section throughout the axial extent of same, the block having an axially extending projection upstanding from the top wall and the bottom wall having an axially extending recess formation of a configuration and extent to match the projection, the projection being spaced inwardly from the front facing to present an uninterrupted flat top wall portion therebetween and rearwardly in relation to the axis a selected extent exceeding that of the recess whereby when such blocks are disposed in horizontal courses one upon the other to present the projection upwardly each overlying horizontal course is automatically uniformly set back from the next below horizontal course and thereby define a uniformly inclined wall structure.

22 Claims, 13 Drawing Figures

FIG. 3
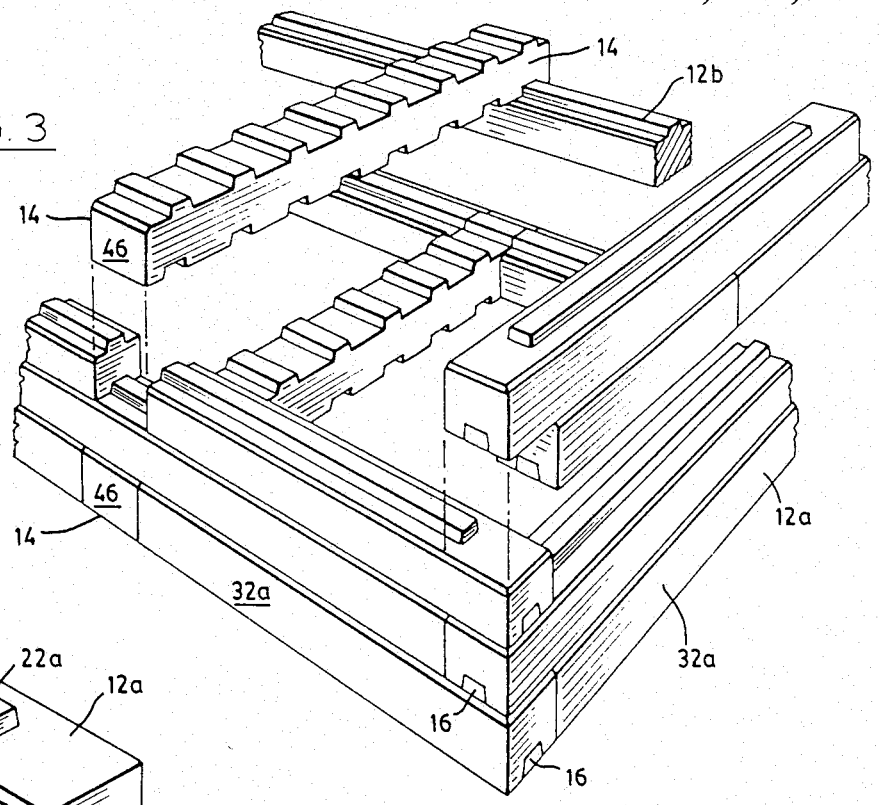
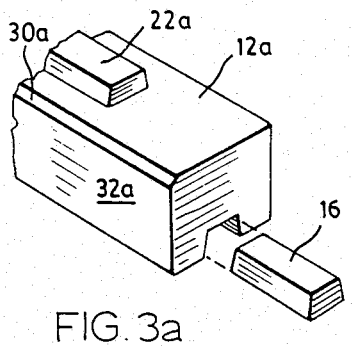
FIG. 3a
FIG. 2
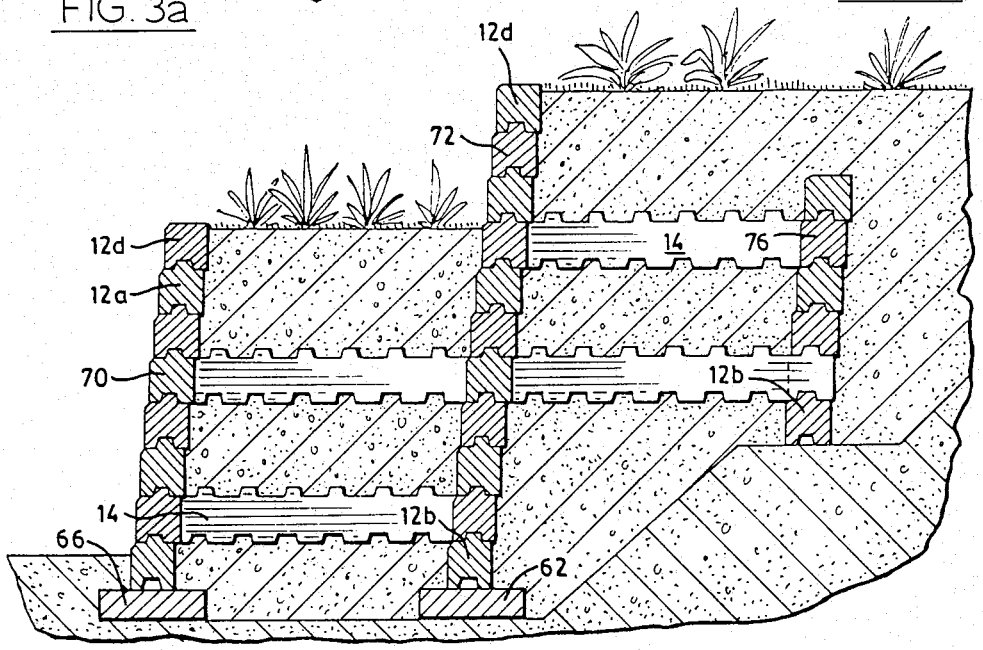

RETAINING WALL SYSTEM

THE FIELD OF INVENTION

This invention relates to improvements in retaining wall systems and cribbing and particularly to improved interlocking precast concrete stretchers and headers from which such system or cribbing and other related useful structures can be built.

BACKGROUND OF THE INVENTION

Retaining walls can be constructed in a conventional way from a suitable concrete mix poured into requisite forms mounted on footings which, upon curing and removal of the forms and after suitable trimming and smoothing over of the rough edges and surfaces, are backfilled and landscaped to complete the job. Such an approach provides a very strong and durable structure but is time-consuming and costly normally requiring skilled labour and heavy commercial equipment to undertake and complete the project.

It is also common practice to construct a retaining wall from precast concrete slabs or from trimmed rock slabs or rock pieces mounted upon suitably prepared footings. The slabs or pieces can be of a size and weight sufficient in themselves to maintain the wall profile. Mortar can be used to anchor the slabs or rock pieces in place. Such proposal is likewise time-consuming and expensive, normally requiring skilled labour to achieve acceptable standards.

Interlocking precast concrete stretchers or slabs and headers have been produced and used to build suitable retaining walls and cribbing in which mortar is not required except for securing the top or coping block or stretcher or slab against dislodgement and in relation to which skilled labour is required only in the initial phases to establish the requisite base for such structure and for trimming the slab lengths and corners.

Such structures are described and illustrated in U.S. Pat. Nos. 1,77,579; 1,787,200; 2,972,870 and Canadian Pat. No. 941,626. It is to be noted in connection with the precast concrete stretcher and header structures of the aforementioned patents that although the retaining walls to be constructed require only a shallow excavation for a footing where loads are substantial in circumstances wherein the structure will have a substantial height, skilled labour is required in preparing the footings and the laying of the first course of stretchers and headers because they must be disposed at a selected angle to the horizontal in order to establish the requisite degree of inclination of the retaining wall or cribbing. This inclination is essential to preserve the long term stability of the structure and to meet governmental regulations concerning safety.

More sophisticated units for constructing retaining walls or cribbing are disclosed by recently issued U.S. Pat. Nos. 3,877,236; 4,190,384 and 4,278,364.

Treated wooden logs are widely used in the construction of retaining walls or structures such as stairways and in cribbing in the landscaping of both commercial and domestic properties. This alternative while aesthetically pleasing, requires skilled labour. Moreover, treated wooden log structures are more costly than the equivalent precast concrete block or rock slab installation and tend to show damage by splitting through abrasion and by disintegration.

OBJECTS OF THE INVENTION

One principal object of this invention is to provide an improved precast concrete stretcher or "log-like" block which when laid or mounted in courses upon a level base or footing interlock with each other in a manner that gives rise to the erection of a substantially uniform stable retaining wall or cribbing structure automatically inclined to the vertical at a predetermined requisite angle that ensures stability and meets governmental regulations.

Another important object is to provide interlocking precast concrete stretchers or headers or a "log-like" configuration which can be assembled together to form stable rigid crib structures that present exposed superimposed multiples of retaining wall units of any required height and extent at the predetermined requisite inclination with the supporting and anchoring headers and stretchers buried under suitable backfill which cribbing structures can be readily adapted to accomodate a very wide range of topographical conditions.

Still another important object is to provide interlocking precast concrete stretchers and headers of the aforementioned loglike configuration which offer attractive architectural alternatives or arrangements, for example, stairways which can be readily built to specification or adapted to meet the requirements of the landscape as the work progresses, from the standard components that are provided.

Another object is to provide interlocking concrete stretchers and headers which pose no special hazard so far as the exposed surfaces or facings are concerned and have an aesthetically satisfying or pleasing appearance so as to merit recommendation for use in all manner of sites, for example, for municipal or provincial or state highway embankments, or in institutional, commercial or domestic settings as well as for the landscaping of parks or recreational areas generally.

A very important object is to provide a retaining wall system or cribbing structure derived from precast concrete interlocking stretchers and headers of the aforementioned log-like configuration which is competitive with other proposals available in the marketplace, particularly a system or structure that can be manufactured at relatively low cost and installed or erected with a minumum of skilled labour and supervision and which will endure over an extended period of time.

FEATURES OF THE INVENTION

One principal feature of this invention resides in providing a precast concrete stretcher or "log-like" member wherein the upper or superior courses of such stretchers or "log-like" members of the system, when mounted in interlocking relation upon the lower or inferior courses, are supported in a manner such that the stretchers of the superior courses are disposed slightly inwardly from the facings of the stretchers of the inferior courses and towards the embankment to thereby establish a predetermined inclination inwardly of the lowermost course requisite both to continued stability of the structure as well as meet to governmental regulations concerning safety.

More particularly, in the preferred system the precast concrete stretcher or "log-like" member aforementioned is provided with a projection or plurality of projections extending upwardly from the upper surface thereof and includes a matching recess formation opening to the lower surface thereof, the projection or projections being spaced from the exposed facing of the stretcher or "log-like" member a selected distance greater than that of its matching recess formation from the exposed facing, such projection or projections and recess formation being so shaped and of an extent such that with one such stretcher mounted upon another and with the upwardly extending projection of the inferior stretcher registered within the matching recess of the superior stretcher the latter is securely supported with its exposed facing located slightly uniformly inwardly of the facing of the inferior stretcher and held against transverse dislodgement in that position.

Still another feature resides in providing the aforementioned matching recess formation for such concrete stretcher in the form of an open ended longitudinally extending channel of substantially uniform configuration throughout its extent whereby when presented to the projection or projections extending upwardly from the underlying support surface of the lower or inferior stretcher the superior stretcher can be shifted longitudinally therealong and so allow for the staggering of the stretchers which is fundamental to the stability of the structure.

Whereas the matching recess formation provided in such concrete stretcher may extend from end to end, the projection or projections may be confined or limited to only a portion of the longitudinal extent of same and so arranged as to leave the upper surface in the region of the ends flat or free of any projection so that a change in direction, or a corner can be readily incorporated into the structure.

Another feature of this invention resides in providing a precast or reinforced tie back or concrete header wherein the configuration of the projections and recess formation and cross-sectional dimensions of the first mentioned concrete retaining wall stretcher is reproduced at measured intervals throughout the longitudinal extent thereof, the header having a selected width to establish the requisite strength required of such unit and suitably reinforced so as to carry the load or tension, the exposed portion or forward end thereof embodying the precise cross-sectional shape of the first mentioned retaining wall stretcher so that upon placement of such forward end upon the appropriate selected course in the retaining wall under construction it snugly registers and interlocks with both such inferior projection and superior recess formation of the respective stretchers to thereby securely tie the exposed retaining outer wall structure to the embankment and hold same against dislodgement with the exposed facing of the forward end portion of such header having a configuration matching the shape of the facings of the adjacent retaining stretchers to complete the facade.

Moreover, because of the sequentially repeated configuration and dimensions of the cross-section of the retaining wall stretcher at intervals throughout the longitudinal extent of the header the interlocking relationship of header with inferior and superior retaining wall stretchers can be selectively established at spaced intervals from the exposed or outermost retaining wall and thereby define an interlocking crib structures extending rearwardly therefrom and thereby anchor the structure against displacement when backfilled.

It is also a feature of this invention that the retaining wall stretchers or "logs" and headers can interlock to provide a composite stepped structure which includes a secondary lower principal retaining wall formation, with an upper retaining wall formation, stepped back therefrom a selected distance, the recess formations of the lowermost course of blocks of the upper secondary retaining wall formation being supported upon spaced apart headers which extend rearwardly of the lower principal retaining wall formation and in interlocking relationship therewith, which headers are preferrably additionally supported upon rear stretchers spaced inwardly from the exposed principal retaining wall to complete a structurally sound crib structure.

Still another feature of this invention resides in suitably dimensioning and contouring the exposed surfaces or facings of the stretchers to simulate a "log-like" appearance, while eliminating any sharp projecting edge or corner that naturally arises because of the stepping back of each successive course of stretchers which if not contoured or altered could easily be scaled by children or because of the sharpness and roughness of such edges or corners could cause injury if contacted, as well as to promote the run-off of ground water and rain water and not only so preserve the continued stability and extend the life of such structure but enhance its appearance.

THE DRAWINGS

These and other objects and features are outlined in the following description to be read in conjunction with the sheets of drawings in which FIG. 1 is a vertical cross-sectional view of an embankment defined by a retaining wall system embodying the invention, including stretchers and headers and coping blocks together with appropriate footings backfill and drainage requirements;

FIG. 2 is an vertical cross-sectional view of an embankment defined by an alternative retaining wall system embodying the invention showing the use of extended cribbing and footings together with the backfill requirements;

FIG. 3 is a perspective view of a typical retaining wall system embodying the invention, partly broken away and partly exploded to illustrate the manner in which the cribbing is erected and particularly the character of the corner structure derived from the log-like stretchers;

FIG. 3A is a portion of one end of one embodiment of stretcher, shown in perspective and illustrating the manner of closing the open end of the recess formation formed therein by means of a plug;

THE PREFERRED EMBODIMENTS OF THE INVENTION

Figure 1:
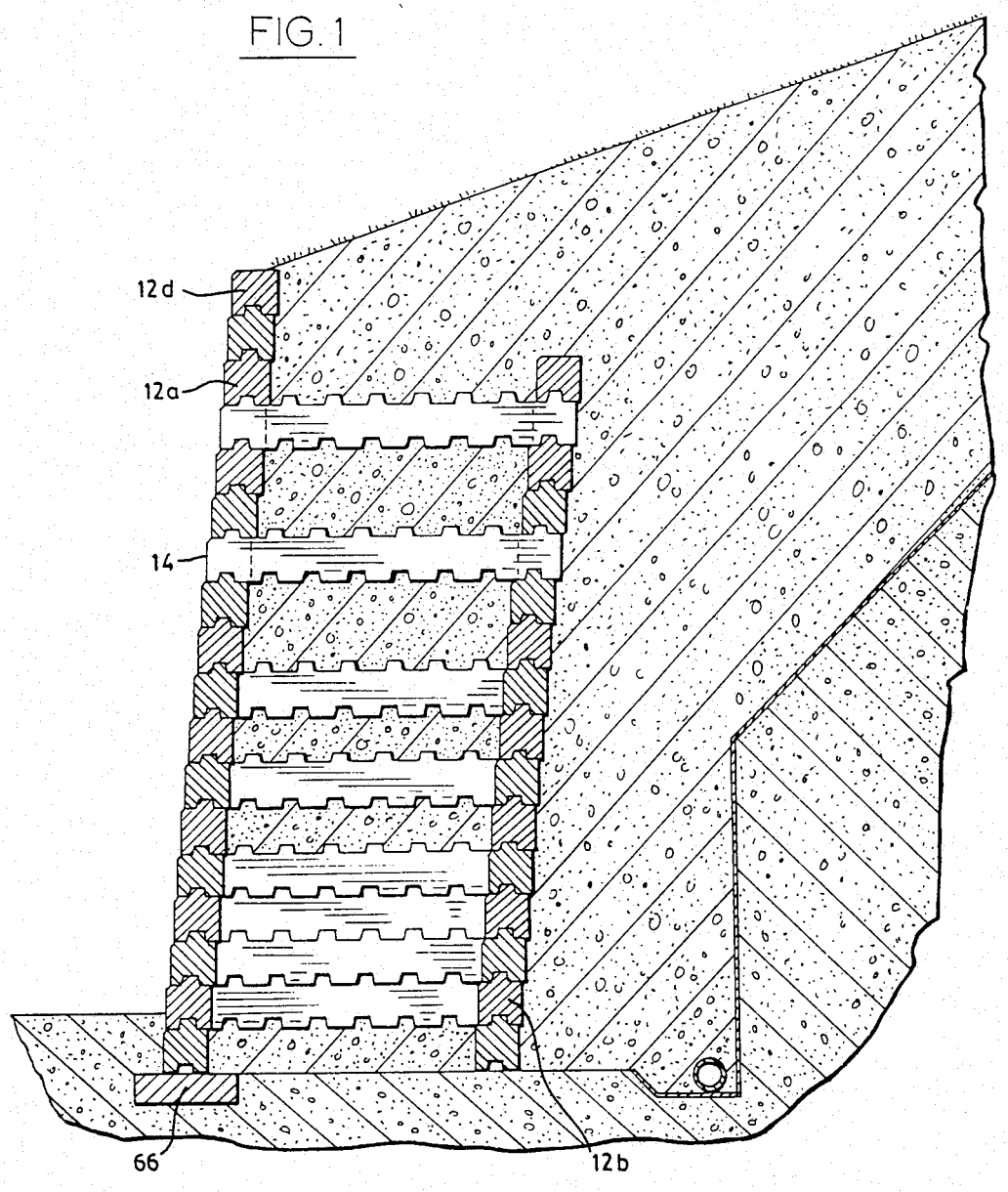
Figure 4:
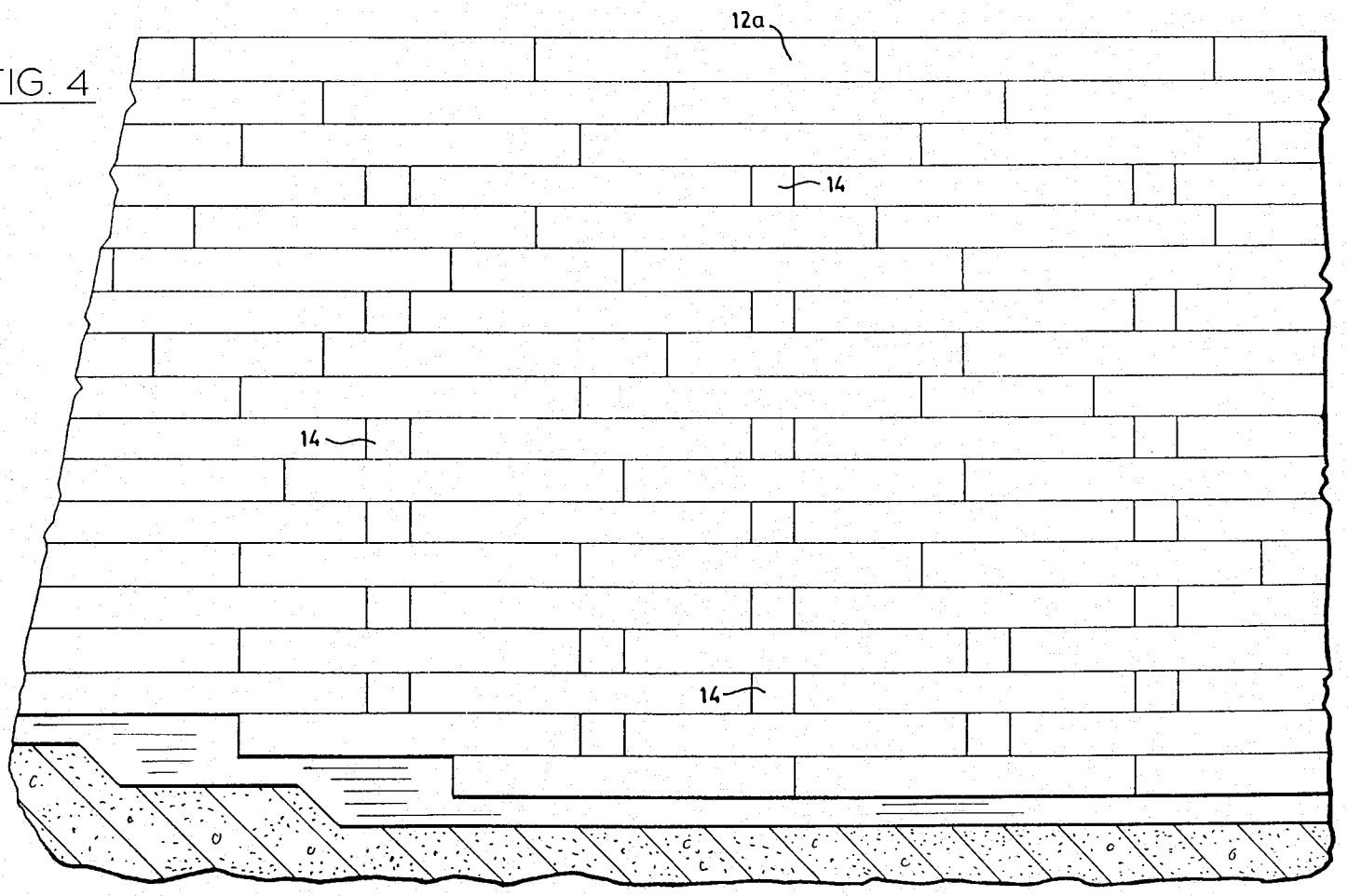
FIG. 4 is a front elevational view, partly broken away at each end of the retaining wall system illustrated in FIG. 1.
Figure 5:
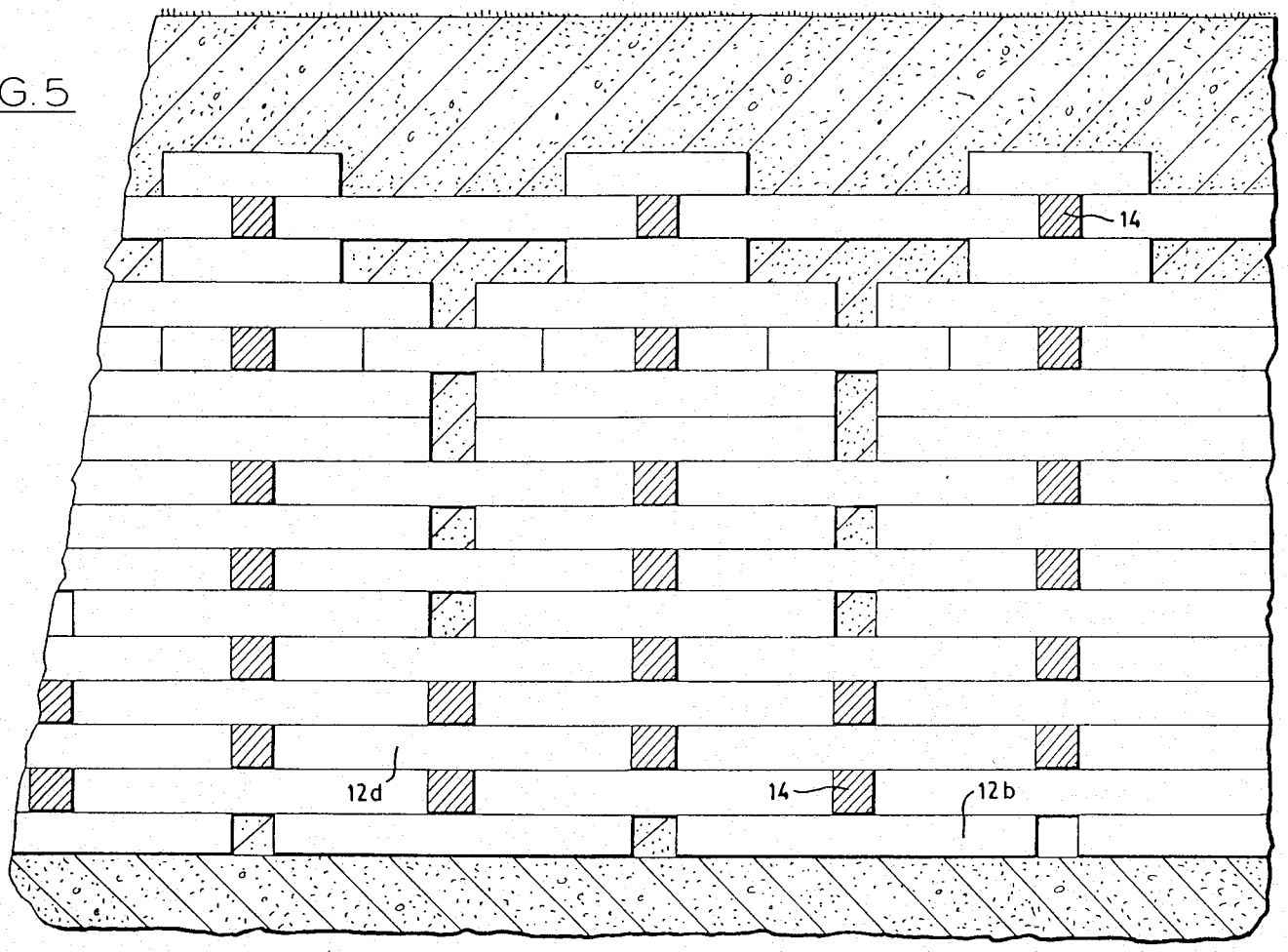
FIG. 5 is a rear elevational view partly broken away and partly in cross-section of the arrangement of back stretchers and headers of the cribbing structure of the retaining wall system of FIG. 1.

According to the invention the preferred retaining wall systems or cribbing structures illustrated in the drawings are derived essentially from the following units: front stretchers 12*a*, rear stretchers 12*b*, headers 14, coping blocks or top stretchers 12*d* tie backs or headers 14 and an insert or plug 16, which is illustrated particularly in FIG. 3A.

Figure 9:
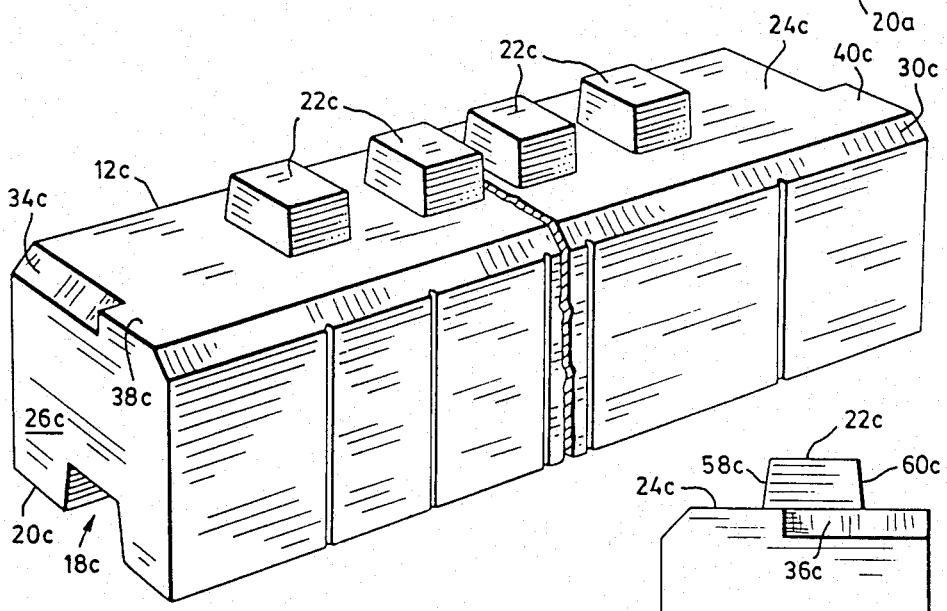
FIG. 9 is another preferred embodiment of front stretcher that can be used in erecting the retaining wall systems of FIGS. 1 to 5.
Figure 10:
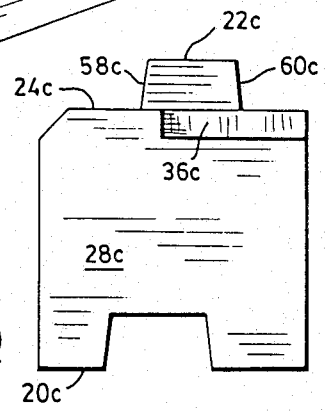
FIG. 10 is an end elevational view of the embodiment of front stretcher shown in FIG. 9 taken from the right.

An alternative form of stretcher such as that depicted in FIGS. 9 and 10 and identified as 12*c* can be substituted for either front or rear stretcher 12*a* or 12*b* if desired.

Front and rear stretchers 12*a*, 12*b* as well as alternative stretcher 12*c* and top stretcher 12*d* are all provided with like longitudinally extending uniform recess formations 18*a*, 18*b*, 18*c* and 18*d* respectively in their lowermost surfaces 20*a*, 20*b*, 20*c* and 20*d* respectively.

In the case where the stretchers are used to establish an exposed corner of the retaining wall system such as that arrangement illustrated in FIG. 3 of the drawings suitable inserts or plugs 16 are used to close the open ends of the respective recess formations 18*a*, 18*b*, 18*c* and 18*d* using an appropriate epoxy cement or mortar, in the manner illustratd in FIG. 3A.

It will be noted that front stretcher 12*a* is provided with an upper projection 22*a* matching the contour of recess formation 18*a* and extending above the upper surface 24*a* but inwardly offset in relation to lower recess formation 18*a* thereof with projection 22*a* terminating inwardly of the end walls 26*a*, 28*a* of such unit, a distance corresponding approximately to the width of such unit. Such stretcher 12*a* is particularly useful for and primarily intended to establish the corner structures of the retaining wall systems or cribbings as illustrated in FIG. 3.

Likewise alternative front stretcher 12*c* shown in FIG. 9 and FIG. 10 is provided with a number of projections 22*c* matching the contour of recess formation 18*c* but likewise offset inwardly in relation to same and extending above the upper surface 24*c* thereof with the outermost projections terminating inwardly of the end walls 26*c*, 28*c* of such unit a distance corresponding approximately to the width of such unit to facilitate the construction of a corner therefrom in the manner taught by FIG. 3.

Rear stretcher 12*b* is provided with matching projection 22*b* inwardly offset in relation to recess formation 18*b* and extending upwardly from the upper surface 24*b* thereof the full length of the unit from end wall 26*b* to end wall 28*b*. Such rear stretcher 12*b* can also be used as a front stretcher for the main uninterrupted sections of the exposed wall of the retaining wall system or at the corners if desired, but if used at the corners the upper projection 22*b* must be partly removed.

The coping block or top stretcher 12*d* as compared with stretchers 12*a*, 12*b* and 12*c* has a flat or planar upper surface 24*d* to finish the appearance of the exposed wall system.

Stretchers 12*a*, 12*b*, 12*c*, and 12*d* are derived from a suitable concrete mix compacted in requisite molds and removed therefrom for curing, all in a manner well known to this industry.

Each stretcher 12*a*, 12*b*, 12*c*, and 12*d* preferably has a bevel or chamfer 30*a*, 30*b*, 30*c* and 30*d* respectively extending longitudinally along the upper edge of the front facings 32*a*, 32*b*, 32*c* and 32*d* thereof respectively.

It will be observed from the embodiments of the front stretchers 12*a* and 12*c* illustrated in FIGS. 7 to 10 inclusive that bevels or chamfers extend not only longitudinally along the upper edges of their front facings as at 30*a* and 30*c* respectively but also partly along the rearward portions of the upper edges of opposed end walls 26*a*, 28*a*, and 26*c*, 28*c* respectively as at 34*a*, 36*a* and 34*c*, 36*c* respectively.

Each such stretcher 12*a* or 12*c* can be used either as an intermediate front stretcher in the exposed retaining wall portion of the systems illustrated in FIG. 1 or 2 of the drawings or at a corner such as that illustrated in FIG. 3 of the drawings.

If either stretcher 12*a* or 12*c* is to be used at a corner of the structure those portions 38*a* or 40*a*, or 38*c* or 40*c* at the respective end walls can be chiselled off to complete the bevels 34*a*, 36*a* or 34*c*, 36*c* along the entire upper edge of their respective end walls and so complete the bevelled profile of the corner as depicted in FIG. 3 thereby not only removing the sharp corners but providing the uniform log-like appearance.

Figure 11:
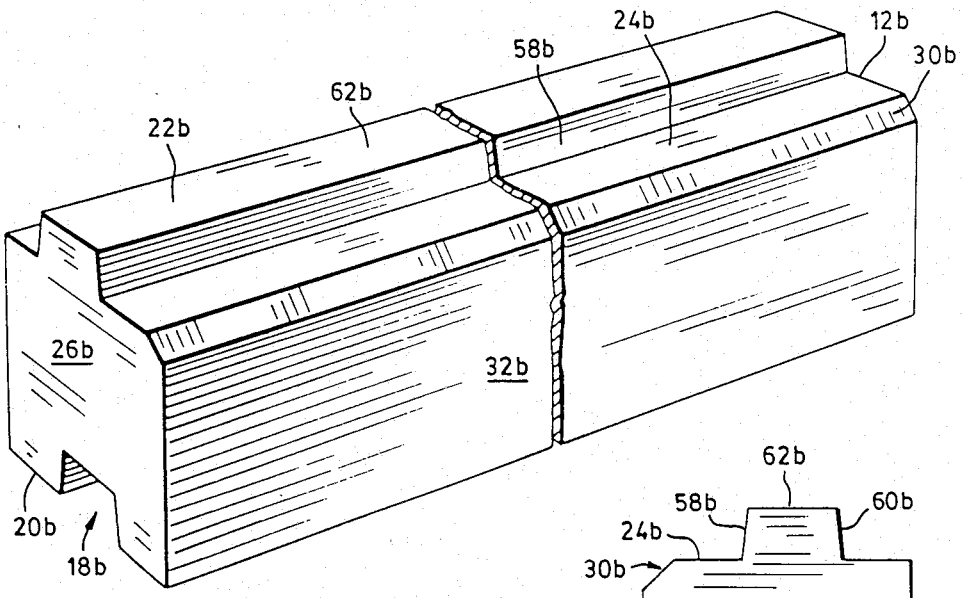
FIG. 11 is a perspective view of a preferred embodiment of back stretcher for use in erecting the retaining wall systems of FIGS. 1 to 5 inclusive and, FIG. 12 is an end elevational view of the embodiment of back stretcher shown is FIG. 11 taken from the right.
Figure 12:
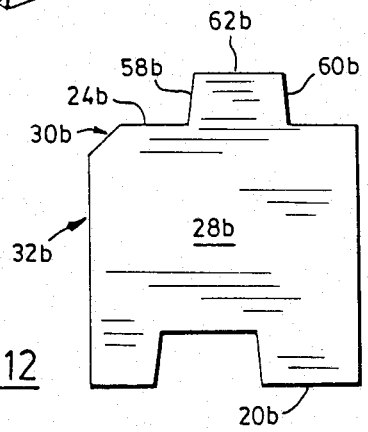

It will be understood that by using a rear stretcher 12*b* as illustrated in FIGS. 11 and 12 as a component for an exposed retaining wall portion, upper projection 26*b* in extending from end to end hinders the escape of ground waters from the backfill and embankment and if used at a corner of a structure requires not only the removal of that portion of the upper projection 22*b* adjacent the end wall thereof exposed at the corner but a bevel must be chiselled along the upper end edge to complete the facade.

On the other hand, stretcher 12*a* permits the escape of ground water more readily in that the upper projection terminates inwardly of the abutting ends. Moreover, as earlier indicated, stretcher 12*a* as depicted in FIG. 3 is intended to accommodate the ready construction of a corner in the retaining wall system and the ready bevelling of the entire upper edge of the end walls 26*a* or 28*a* by removing those portions 38*a* or 40*a*.

By using stretchers 12*c* in the exposed wall formation several paths between upper projections 26*c* are provided increasing the number of drainage paths that can be taken by the ground waters, and as in the case of front stretcher 12*a*, alternative front stretcher 12*c* can be used in the ready construction of the corner.

Accordingly in the specification of any particular retaining wall system given the particulars or character of the embankments or the backfill and the water table several choices of stretchers are available to meet the conditions.

Figure 6:
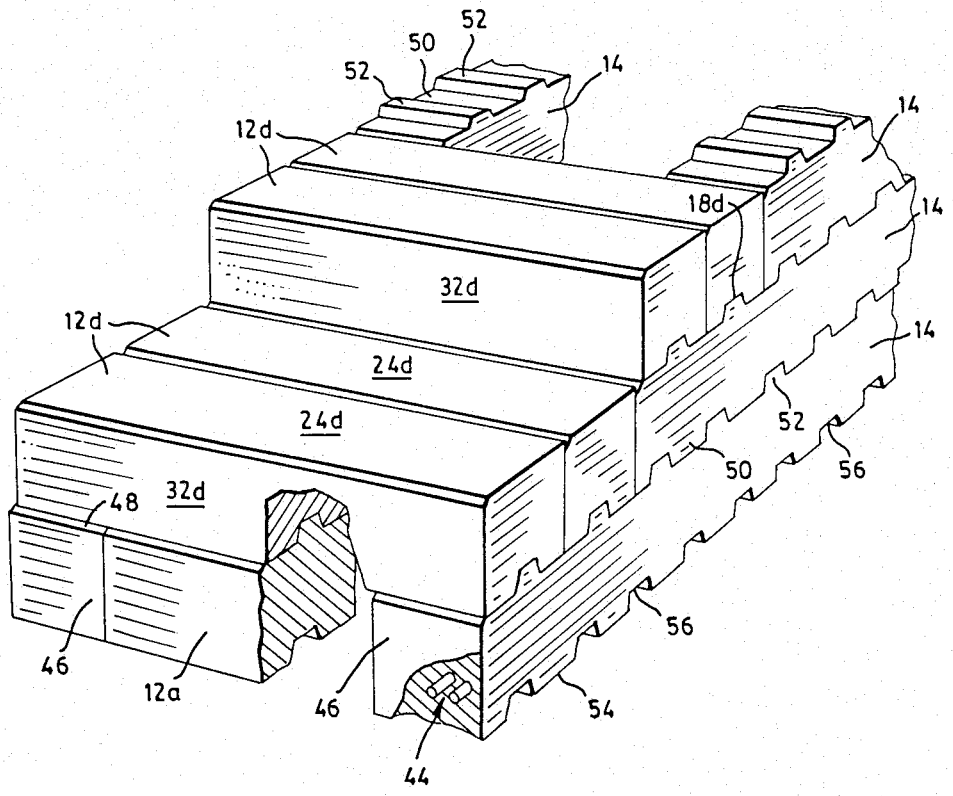
FIG. 6 is still another alternative retaining wall system embodying the invention which incorporates a stair structure thereinto.

The tie back or header 14 illustrated particularly in FIG. 3 in perspective, is likewise derived from a suitable concrete mix cast in a requisite mold and removed therefrom for curing. Tie back or header 14 is reinforced longitudinally as at 44 with suitable steel reinforcing rods as shown in FIG. 6.

The front facing 46 of header 14 has vertical dimensions corresponding to the dimensions of the front facings 32*a*, 32*b* and 32*c* of the respective stretchers 12*a*, 12*b* and 12*c*. Header 14 is likewise provided with a like bevel or chamfer 48 along the upper edge of its front or exposed facing 46.

Upper surface 50 of header is planar and is provided with a series of like projections 52 arranged in uniformly spaced apart relation and parallel to front facing 46 thereof.

Lower surface 54 of header 14 is provided with correspondingly spaced matching recess formations 56 arranged in parallel relation to each other and to the projections 52 and to the front facing 46 thereof and offset forwardly in relation to upper projections 52.

Typically, the stretchers and headers have principal dimensions of the order of 6"×6"×47" (equivalent to 15 cm×15 cm×120 cm) excluding the upper projections.

The preferred cross-sectional configuration of the upper projections 22*a*, 22*b* and 22*c* and the matching recess formations 18*a*, 18*b*, 18*c* and 18*d* of respective stretchers 12*a*, 12*b*, 12*c* and 12*d* are typically trapezoidal.

The forward surfaces 58*a*, 58*b* and 58*c* of projections 18*a*, 18*b* and 18*c* are rearwardly and upwardly inclined and the rearward surfaces 60*a*, 60*b* and 60*c* thereof are forwardly and upwardly inclined each terminating in a flat top surface 62*a*, 62*b* and 62*c* respectively extending generally parallel to the upper surfaces 24*a*, 24*b* and 24*c* thereof.

Recess formations 18*a*, 18*b*, 18*c* and 18*d* have a configuration corresponding to the configuration of matching projections 22*a*, 22*b* and 22*c* but so far as the dimensions are concerned the recess formation dimensions slightly exceed the dimensions of the projections by an amount sufficient to give adequate clearance to ensure full registration of the projection within the recess formations and for relative displacement therebetween in sliding fit.

Figure 7:
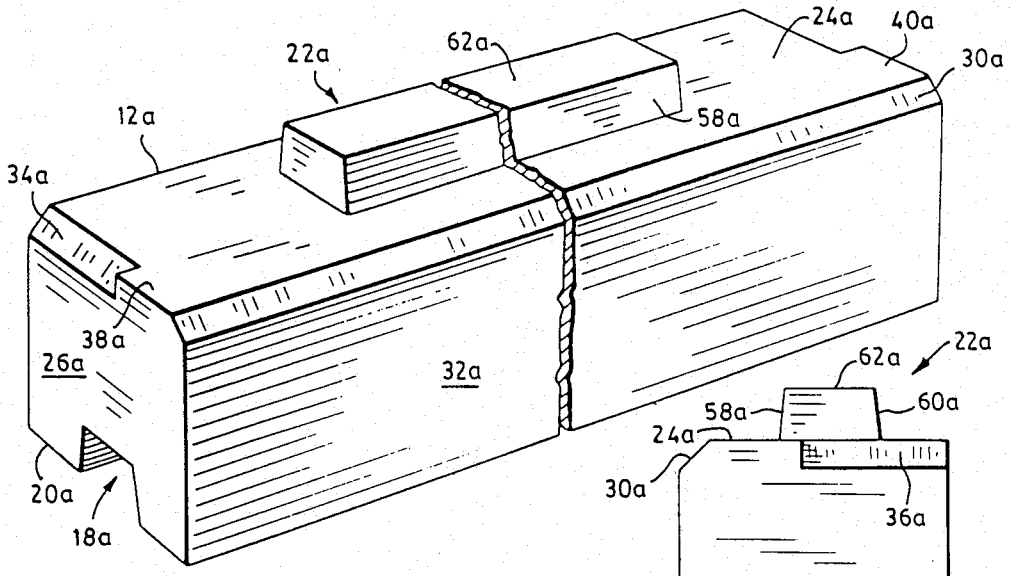
FIG. 7 is a perspective view of a preferred embodiment of front stretcher for use in erecting the retaining wall systems of FIGS. 1 to 5 inclusive.
Figure 8:
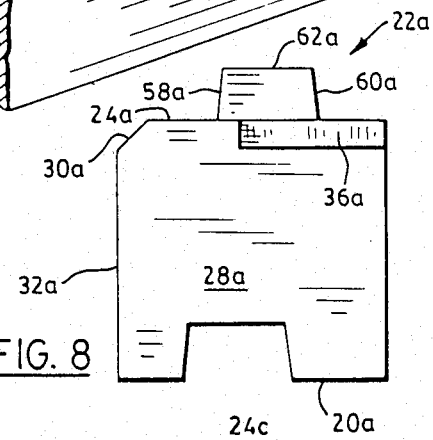
FIG. 8 is an end elevational view of the front stretcher of FIG. 7 taken from the right.

Typically, the width of the top wall of the recess 64*a* of stretcher 12*a* as indicated in FIGS. 7 and 8 is of the order of 2.2 inches (55 mm) and exceeds the width of top wall 62*a* of projection 22*a* by 0.2 inches (5 mm) with the depth of the recess of the order of 1.4 inches (35 mm) likewise exceeding the depth of the projection by approximately 0.2 inches (5 mm) and the lower open side 63*a* of the recess formation 18*a* of the order of 2.4 inches (60 mm) exceeding the base of projection 22*a* by 0.2 inches (5 mm).

The recess formation 18*a* of front stretcher 12*a* is spaced rearwardly from the front facing 32*a* thereof measured along the lowermost surface 20*a* a distance of typically the order of 1.4 inches (or 35 mm) whereas upper projection 22*a* is set further back from such front or forward facing 32*a* a distance of the order of 2.3 inches (57.5 mm).

Likewise, in respect of stretchers 12*b*, 12*c* and header 14 for a given system, the dimensioning and the configurations of the upper projections and lower matching recess formations will be of the same order as applied to stretcher 12*a*.

In particular in respect of header 14 each longitudinal section thereof that includes an upper projection 52 and a lower matching recess formation 56 measures 6 inches (150 mm) thereby dimensionally repeating the typical cross section of cooperating stretchers 12*a*, 12*b*, 12*c* and top stretcher or coping block 12*d*.

It can be demonstrated, particularly by FIG. 6 that two lengths or modules of the top stretcher or coping block 12*d* can register in side-by-side abutting relation upon aligned spaced apart headers 14 with their matching recess formations 18*d* in full registration with the upper projections 52 of spaced headers 14 thereby confirming the dimensional conformity of header 14 with the other components.

With reference to FIGS. 1, 2 and 3 of the drawings, in order to build the retaining wall systems illustrated, the area is excavated to a depth of the order of 8 inches (230 mm) and the first or lowermost course is placed upon 2 to 3 inches (50–75 mm) of compacted granular base and the lowermost or first course levelled accurately in all directions. This base may also include levelling pads 66.

The first or lowermost course of the portion of the retaining wall structure to be exposed to view can be selected from any one of stretchers 12*a*, 12*b* or 12*c* but preferably either stretchers 12*a* or 12*c*.

The first and subsequent courses of the inner wall crib structure is preferably derived from back stretchers 12*b* in combination with tie backs or headers 14.

The exposed wall and inner wall stretchers are successively laid as normal brickwork, including the offsetting of the vertical joints and the insertion of tie backs or headers 14 at requisite intervals.

With reference to FIG. 1 tie backs or headers 14 are disposed in each course above the lowermost or first course up to the fifth course, thereafter up to the seventh course the tie backs or headers 14 are inserted in alternate courses, and thereafter upwardly in every third course.

In the case of the retaining wall structure of FIG. 2 the tie backs or headers 14 are located in every third course above the first or lowermost course of stretchers.

Typically, tie backs or headers 14 are placed at 8 foot centers.

If the retaining wall systems illustrated in FIGS. 1 to 5 inclusive are erected in accordance with the steps outlined, the exposed retaining wall as well as the interior wall derived respectively from the front and back stretchers interconnected as illustrated by the tie backs or headers 14 will automatically assume a uniform inward inclination derived from the offsetting of the respective matching upper projections 22*a*, 22*b* and 22*c* and recess formations 18*a*, 18*b*, 18*c* and 18*d* of the respective stretchers as well as the matching projections 52 and recess formations 56 of tie backs or headers 14.

The erected exposed retaining wall will be capped or finished off with top stretchers or coping blocks 12*d* as indicated in FIGS. 1 and 3.

By reason of the dimensional constraints the facade presented by the facings 32*a*, 32*b*, 32*c* and 32*d* together with the matching facings 46 of tie backs or headers 42 and matching bevels 30*a*, 30*b*, 30*c*, 30*d* and 48 present a smoothly contoured surface.

With reference to FIG. 2, it will be observed that the retaining wall system includes an extended crib structure or enclosure, the first or outermost wall 70 ascending from the outer footings to an intermediate height, which is keyed to and supported by an intermediate interior retaining wall 72 which rises above the height of wall 70. With such an arrangement a stepped configuration can be readily incorporated.

By extending the crib structure to include a third wall 76 an extremely durable and strong supporting interlocking crib structure is established for the embankment.

According to FIG. 3 the outer corner structure is derived from superimposed stretchers 12*a* by alternatively overlapping the ends of the staggered stretchers 12*a* with the corner plugs 16 inserted and securely anchored by means of an epoxy cement to provide a finished corner appearance.

From FIG. 3 it will be observed that the modules consisting of stretchers 12*a* and 12*b* and tie back or headers 14 are self-locking when in place with the tongue and groove system so defined presenting a retaining wall system or crib structure having appropriately inclined substantially rigid walls.

The structure can be used not only for varied landscape design, for example, in the creation of planter areas or terraces or as in the case of FIG. 6, a stair structure or sitting area, but because of the interlocking relationships resists displacement and ensures continued stability.

According to the alternative illustrated in FIG. 6, as earlier mentioned, spaced tie backs or headers 14 are disposed in suitably spaced apart parallel relation, the separation at the front facings 46 thereof being closed by an appropriately dimensioned front stretcher 12*a* cut to length.

Superimposed upon the spaced apart pair of tie backs or headers 14 whose upper projections 52 are aligned with the upper projection 22*a* of front stretcher 12*a* is a coping block or top stretcher 12*d* also appropriately cut to length.

Rearwardly a second appropriately dimensioned coping block or top stretcher 12*d* cut to length is deposited upon the second pair of upper projections 52 of the respective tie backs or headers 14, the matching recess formations 18*d* of the coping blocks or top stretchers 12*d* registering and locating the respective coping blocks in side-by-side abutting relation.

Mounted in superimposed relation upon the remaining longitudinal extent of the lowermost tie backs or headers 14 are a second pair of like headers 14*a* and in the same manner, two additional coping blocks or top stretchers 12*d* are placed in registration upon the second pair of tie backs or headers 42 in side-by-side abutting relation.

It can be perceived from FIG. 6 that a stair structure with 6 inches (or 150 mm) risers and stair treads of 12 inches (or 300 mm) extent can be provided with the lowermost tie backs or headers 14 and associated front stretcher 12*a* suitably buried and supported upon either prepared footings or levelling blocks or within crib structures such as those illustrated in FIGS. 1, 2 or 3 of the drawings.

It will be understood that a number of alternative retaining wall systems or crib structures can be derived from the several modules or components illustrated and described. Particularly, it is emphasized that in certain conditions where the height is low, for example the tie backs or headers 14 need not be anchored within the embankment upon interior wall formations derived from back stretchers 12*b* but can be placed to extend rearwardly from the exposed front stretchers into the compacted backfill itself and securely tie or anchor the exposed interlocked inclined retaing wall against dislogement.

The upper projections 52 and the lower recess formations 56 of the tie back or header units 14 buried in compacted backfill additionally provide a secure anchor for the exposed retaining wall in those circumstances as well as when used as components of the more complex crib structures.

While the preferred embodiments of this invention have been described and illustrated variations or departures from the particular arrangements or proposals outlined may be undertaken by those persons skilled in this field without departing from the spirit or scope of the invention as defined in the appended claims.

The embodiments of the invention in which an exclusive property or privilege is claimed are defined as follows:

1. In an interlocking block for a retaining wall structure wherein like blocks are laid in horizontal courses one upon the other in end to end relation with the upper blocks interlocking with the lower blocks and displaceable therealong in sliding fit and therebeyond to overlap the adjacent ends of the lower blocks and to extend upwardly as such wall structure is erected at a selected uniform inclination to the vertical said block having an axis terminating in spaced apart end walls and bounded by generally flat top and bottom walls arranged in parallel relation to said axis and to each other and by front and rear facings extending from end wall to end wall and so separated as to provide a substantially uniform cross section throughout the axial extent of same, projecting means upstanding from said top wall and extending axially of said block between said end walls and spaced inwardly from said front facing to present an uninterrupted flat top wall portion therebetween said bottom wall having recess means therein likewise spaced inwardly from said front facing and extending axially of said block between said end walls said projecting means and said recess means having a configuration and extent so as to matingly interlock in sliding fit when such blocks are disposed in horizontal courses one upon the other and in overlapping relation to present said projecting means upwardly, said projecting means being spaced rearwardly in relation to said axis a selected extent exceeding that of said recess means whereby each overlying horizontal course is automatically uniformly set back from the next below horizontal couse so as to define a uniformly inclined wall structure at a selected angle to the vertical.

2. A block according to claim 1 wherein said projecting means includes at least two spaced apart rows of projections extending axially of said block between said end walls and said recess means includes at least two spaced apart rows of recesses extending axially of said block between said end wall.

3. A block according to claims 1 or 2 wherein said recess means and projecting means have a generally trapezoidal configuration in cross-section.

4. A block according to claims 1 or 2 wherein said recess means opens to each of said end walls thereof.

5. A block according to claim 1 wherein said projecting means terminates inwardly of the end walls of said block a distance of the order of the separation between said front and rear facings.

6. A block according to claims 1 or 5 wherein the separation between said front and rear facings and said top and bottom walls are of substantially the same order.

7. A block according to claims 1 or 5 wherein the separation between said front and rear facings and between said top and bottom walls thereof are of substantially the same order and the separation between the end walls exceeds that between said front and rear facing of the order of between two to eight times.

8. A block according to claims 1, 2 or 5 wherein said projecting means comprises a plurality of spaced-apart like projections.

9. A block according to claims 1, 2 or 5 wherein said front facing includes a first region lowermost and a second region uppermost, said second region being inclined to said first region and extending upwardly and rearwardly thereof.

10. In a block having generally parallel flat top, bottom and end walls and a front and rear facing, a plurality of projecting means upstanding from said top wall in uniformly separated rows extending in a direction substantially parallel to said front facing, said row adjacent said front facing being spaced inwardly therefrom and presenting an uninterrupted flat top wall portion therebetween and said bottom wall having a plurality of recesses therein in uniformly separated rows extending in a direction substantially parallel to said front facing, said upstanding projecting means being offset in relation to said recess means and having a matching extent and configuration such that when the plurality of projecting means of one such block is registered within the plurality of matching recess means of another such block, the front facings of such blocks are substantially uniformly offset in relation to each other.

11. In a retaining wall system wherein like interlocking wall defining blocks are laid in horizontal courses one upon the other in end to end relation with the upper blocks interlocking with the lower blocks and displaceable therealong in sliding fit and therebeyond to overlap the adjacent ends of the lower blocks to thereby define a wall structure uniformly inclined to the vertical and wherein a plurality of interlocking anchoring blocks and laid at intervals throughout its extent in horizontal courses interlocking with said wall defining blocks and extending therefrom at substantially right angles thereto in the direction of the inclination of said wall structure, each of said blocks having an axis terminating in spaced apart end walls and bounded by generally flat top and bottom walls arranged in parallel relation to said axis and to each other and by front and rear facings extending from end wall to end wall and so separated as to provide a substantially uniform cross-section throughout the axial extent of same, projecting means upstanding from said top wall and extending axially of said block between said end walls and spaced inwardly from said front facing to present an uninterrupted flat top wall portion therebetween said bottom wall having recess means therein likewise spaced inwardly from said front facing and extending axially of said block between said end walls said projecting means and said recess means having a configuration and extent so as to matingly interlock in sliding fit when such blocks are disposed in horizontal courses to present said projecting means upwardly said projecting means being spaced rearwardly in relation to said axis a selected event exceeding that of said recess means whereby each overlying horizontal course of said blocks are uniformly set back from the next below horizontal couse of said blocks so as to define a uniformly inclined wall structure at a selected angle to the vertical and anchored at intervals throughout its extent by said anchoring blocks.

12. In a retaining wall system wherein a plurality of like interlocking wall defining blocks extend in horizontal couses in end to end abutment and one upon the other in overlapping interlocking retaining wall defining relation and wherein a plurality of interlocking anchoring blocks are laid in horizontal couses and extend at right angles from said plurality of wall defining blocks in wall anchoring relaton thereto at intervals throughout the extent of same, said wall defining blocks and anchoring blocks each having a generally parallel flat top and bottom wall end walls and a front and rear facing, projecting means upstanding from said top wall and extending therealong between said end walls and uniformly set back from said front facing so as to present an uninterrupted flat top wall portion therebetween, said bottom wall having recess means therein extending therealong between said end walls and likewise uniformly set back from said front facing, said projecting means being offset rearwardly in relation to said recess means and having a matching extent and configuration in relation to said recess means such that when the projecting means of lower blocks in one horizontal course are registered within the recess means of blocks in a horizontal course thereabove the front facings of the upper blocks are substantially uniformly rearwardly offset from the front facings of the lower blocks and displaceable longitudinally therealong in sliding fit to overlap the end walls of the lower blocks and wherein said projecting means of said wall anchoring blocks includes at least a second projecting means uniformly set back rearwardly from said first mentioned projecting means to present an uninterrupted flat top wall portion therebetween and a second recess means likewise set back from said first mentioned projecting means, whereby a substantially uniform inclination to the vertical is imparted to said plurality of end to end abutting overlapping interlocking blocks secured against displacement by said plurality of interlocking wall anchoring blocks extending therefrom and with that part of said wall anchoring blocks extending from said first mentioned wall defining blocks presenting said second projecting means and recess means respectively for interlocking engagement with a plurality of like interlocking wall defining blocks extending in horizontal courses and in parallel relation to said first mentioned wall defining blocks.

13. A retaining wall system according to claim 12 wherein a plurality of like interlocking wall defining blocks are arranged to extend in horizontal courses rearwardly of said first mentioned plurality of like interlocking wall defining blocks and in parallel relation thereto and in interlocking engagement with said second projecting means and recess means of said wall anchoring blocks respectively whereby a crib structure is defined.

14. A retaining wall system according to claims 12 or 13 wherein said recess means and projecting means have a generally trapezoidal configuration in cross-section.

15. A retaining wall system according to claims 12 or 13 wherein said recess means opens to each of said end walls thereof.

16. A retaining wall system according to claims 12 or 13 wherein said have projecting means of some of said wall defining blocks terminate inwardly of the end walls of said blocks a distance of the order of the separation between said front and rear facings.

17. A retaining wall system according to claims 12 or 13 wherein the separation between said parallel top wall and bottom wall and said front and rear facings are of substantially the same order.

18. A retaining wall system according to claims 12 or 13 wherein the separation between said parallel top wall and bottom wall and front and rear facing of said wall defining blocks are of substantially the same order and the separation between said end walls of such blocks exceeds the separation between said parallel top wall and bottom wall by the order of between two to eight times.

19. A retaining wall system according to claims 12 or 13 wherein said projecting means of said interlocking wall defining blocks comprises a plurality of spaced apart projections.

20. A retaining wall system according to claims 12 or 13 wherein said front facing includes a first region lowermost and a second region uppermost, said second region being inclined to said first region and extending upwardly and rearwardly thereof.

21. In an interlocking block structure the combination with a plurality of like lower supporting blocks arranged to extend in side by side parallel relation to one another of a plurality of like upper blocks mounted thereon and extending therebetween at substantially right angles thereto, said lower supporting blocks each including parallel flat top and bottom walls and end walls and a front and rear facing each of said lower supporting blocks including a plurality of projecting means upstanding from said top wall therof in uniformly separated rows extending in a direction substantially parallel to said front facing said row adjacent said front facing being spaced inwardly therefrom and presenting a flat top wall portion therebetween and said bottom walls having a plurality of recesses therein in uniformly separated rows extending in a direction substantially parallel to said front facing, said upstanding projecting means being offset in relation to said recess means and having a matching extent and configuration such that when the plurality of projecting means of one such block are registered within the matching recess means of another such block the front facings of such blocks are substantially uniformly offset in relation to each other, each said upper blocks each including a generally parallel flat top and bottom wall end walls and a front and rear facing, with said bottom wall of said upper block having recess means therein extending therealong between said end walls thereof and uniformly set back from the front facing thereof, said recess means of said upper block having a matching extent and configuration in relation to said projecting means of said lower supporting blocks such that when the projecting means of said lower supporting blocks are registered within the recess means of said superior block the front facings of the upper blocks are substantially uniformly rearwardly offset from the front facings of said lower supporting blocks.

22. A structure according to claim 21 wherein the spacing of the uniformly separated rows of said lower supporting blocks is such that a plurality of upper superior blocks can be mounted upon said lower supporting blocks in interlocking relation therewith and extend therebetween at substantially right angles thereto in side by side abutting relation.

* * * * *